United States Patent [19]

Leitner

[11] 4,353,414

[45] Oct. 12, 1982

[54] HEAT EXCHANGER TUBE CLEANING

[75] Inventor: Gordon F. Leitner, Elm Grove, Wis.

[73] Assignee: Water Services of America, Inc., Milwaukee, Wis.

[21] Appl. No.: 178,131

[22] Filed: Aug. 21, 1980

[51] Int. Cl.[3] ..... F28G 15/02

[52] U.S. Cl. ..... 165/95; 134/8; 15/104.06 R; 15/104.6 A; 15/104.06 A

[58] Field of Search ..... 165/94; 134/8; 15/104.6 R, 104.6 A

[56] References Cited

U.S. PATENT DOCUMENTS 3,319,710 5/1967 Heeren et al. ..... 165/95
4,124,065 11/1978 Leitner et al. ..... 165/94

FOREIGN PATENT DOCUMENTS 1900732 8/1970 Fed. Rep. of Germany ..... 165/95

*Primary Examiner*—William R. Cline
*Assistant Examiner*—Theophil W. Streule, Jr.
*Attorney, Agent, or Firm*—Andrus, Sceales, Starke & Sawall

[57] ABSTRACT

The ends of the tubes of a heat exchanger condenser are provided with cage-like basket assemblies including tube cleaning brushes or the like. A distributor arm is disposed to move across the tube ends and cause a counter-flow of fluid to move the brushes through the tubes. The tubes are compartmentalized to form bundles. The compartmentalization of the tubes for fluid counter-flow is accomplished by the baskets themselves. Each basket of the assemblies arrayed to form the boundaries of a desired compartment is formed with an outwardly extending lip, with the lips of adjacent baskets joined to form an elongated contact surface for sealing engagement with the distributor arm. The lips of the adjacent baskets forming the respective compartments are generally arcuate, and the distributor arm portions adapted to engage the elongated contact surface are at least as wide as the arcuate extent of each basket lip. The radius of the lip arc is greater than that of the basket. Each basket lip forms the outer end of a closed partition forming an arcuate basket side wall which extends toward the inner basket end and serves to support the basket longitudinally against any pressure exerted by the distributor arm when sealing contact is made with the lips. The partitions of adjacent baskets are joined to provide a seal against radial passage of liquid therethrough, and the inner partition ends form stops for engagement with the adjacent tube sheets.

9 Claims, 5 Drawing Figures

FIG.3
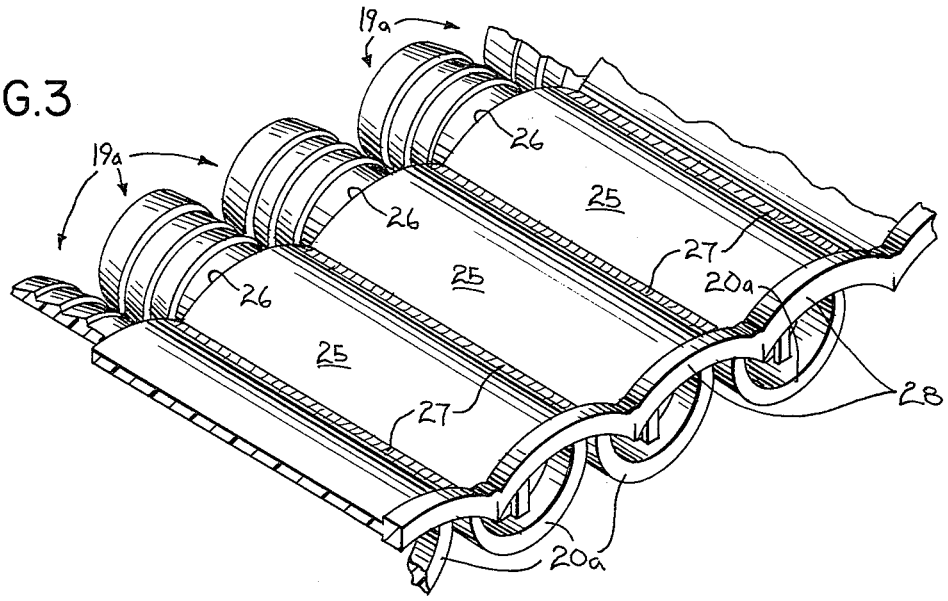
FIG.4
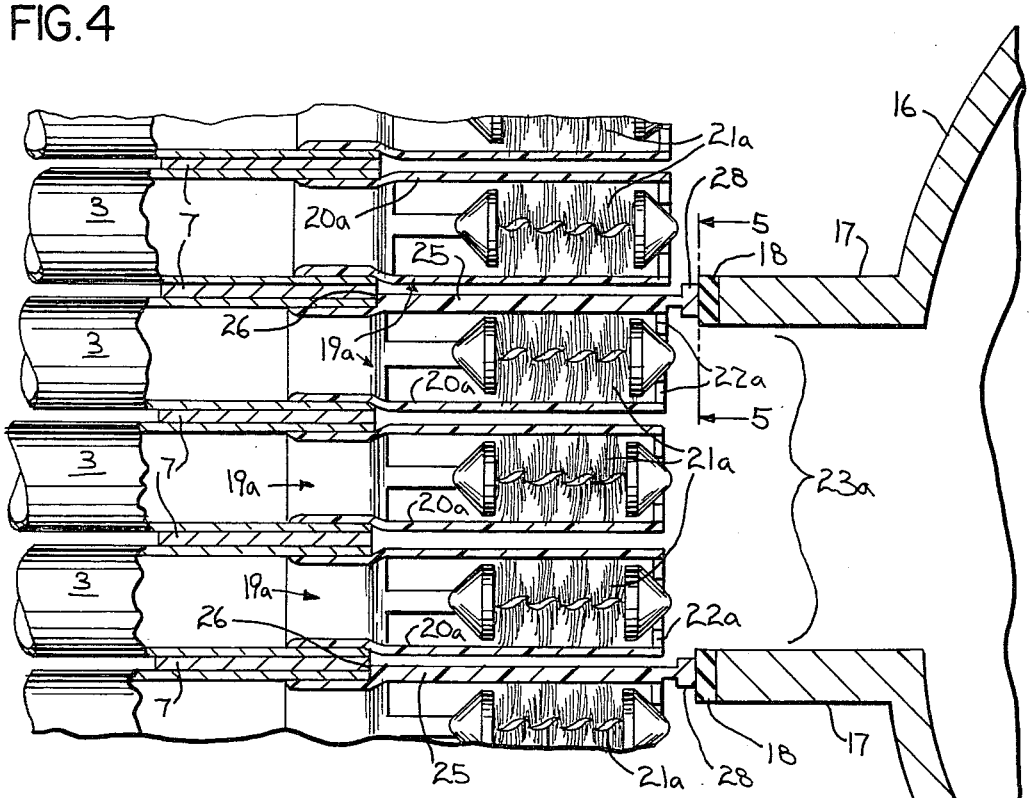
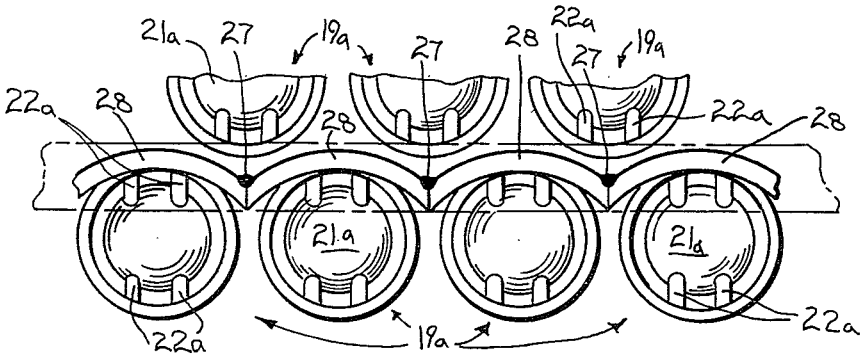
FIG.5

HEAT EXCHANGER TUBE CLEANING

U.S. PRIOR ART OF INTEREST

Heeren et al Pat. No. 3,319,710, Issued May 16, 1967
Leitner et al Pat. No. 4,124,065, Issued Nov. 7, 1978

BACKGROUND AND SUMMARY OF THE INVENTION

This invention relates to heat exchanger tube cleaning and is an improvement over certain concepts disclosed in co-pending U.S patent application Ser. No. 920,644, filed July 3, 1978, now U.S. Pat. No. 4,269,264, granted May 26, 1981, by Richard W. Goeldner, entitled "Cleaning Of Heat Exchanger Tubing", and assigned to a common assignee.

In the said co-pending application, a large plurality of condenser cooling tubes are formed into bundles at one end of the condenser by flow confinement plates or spacers which are secured to the usual tube plates or tube sheets. Basket assemblies containing tube cleaning brushes or the like are mounted at the ends of the tubes. A distributor arm assembly is disposed adjacent the compartmentalized tubes and basket assemblies and is actuatable to sweep across the tube ends, sealing each compartment in succession as it moves. Means are provided to cause a counter-flow of cooling water to flow from the arm assembly and through one bundle of tubes at a time to cause the cleaning brushes to move through the tubes. After the arm assembly passes by a particular bundle, the fluid counter-flow ceases and the brushes return through the tubes to their respective basket assemblies.

It is important that the tubes be compartmentalized or formed into bundles at their ends in order to provide adequate pressure for the fluid counter-flow. Thus, the use of the said flow confinement plates.

In some instances, it may be desirable to convert an existing installation wherein there is no counter-flow system and distributor arm into one which utilizes such concepts. This requires the compartmentalizing of the tube ends. It has been found that in some prior installations, the tubes and their basket assemblies are disposed so close together that the installation of the confinement plates or spacers therebetween is extremely difficult and costly, or may be virtually impossible.

Furthermore, and for efficiency purposes, it is often desirable to utilize as many cooling tubes as possible within a given size condenser. The use of tube confinement plates between the basket assemblies may therefore be undesirable, even in new installations.

It is a task of the present invention to provide a distributor arm counter-flow system which eliminates the need for flow confinement plates or spacers which are disposed between the basket assemblies.

It is a further task of the invention to simplify the installation of a distributor arm counter-flow system in a previous installation not utilizing these concepts.

It is yet another task of the invention to assist in the utilization of as many tubes as possible in a condenser of given size.

In accordance with one aspect of the invention, the compartmentalization of the tubes for fluid counter-flow is accomplished, not by spacers between the basket assemblies, but by the basket assemblies themsevles.

In accordance with another aspect of the invention, each basket of the assemblies arrayed to form the boundaries of a desired compartment is formed with an outwardly extending lip, with the lips of adjacent baskets joined to form an elongated contact surface for sealing engagement with the distributor arm.

In accordance with yet another aspect of the invention, the lips of the adjacent baskets forming the respective compartments are generally arcuate, and the distributor arm portions adapted to engage the elongated contact surface are at least as wide as the arcuate extent of each basket lip. The radius of the lip arc is greater than that of the basket.

In accordance with a further aspect of the invention, each basket lip forms the outer end of a closed partition forming an arcuate basket side wall which extends toward the inner basket end and serves to support the basket longitudinally against any pressure exerted by the distributor arm when sealing contact is made with the lips.

In accordance with additional aspects of the invention, the partitions of adjacent baskets are joined to provide a seal against radial passage of liquid therethrough and the inner partition ends form stops for engagement with the adjacent tube sheets.

BRIEF DESCRIPTION OF THE DRAWINGS

The accompanying drawings illustrate the best mode presently contemplated by the inventor for carrying out the invention.

In the drawings:

FIG. 3 is a perspective view of a plurality of basket assemblies incorporating the concepts of the present invention, and which are joined together;

FIG. 4 is a view similar to FIG. 2 and showing the back-flow cover in sealing engagement with a compartment formed by the basket assemblies; and FIG. 5 is a sectional view taken on line 5—5 of FIG. 4.

DESCRIPTION OF THE PREFERRED EMBODIMENT

The concepts of the invention may be utilized in connection with tube type heat exchangers of the steam condenser type, such as is disclosed in the aforementioned co-pending U.S. patent application Ser. No. 920,644.

Figure 1:
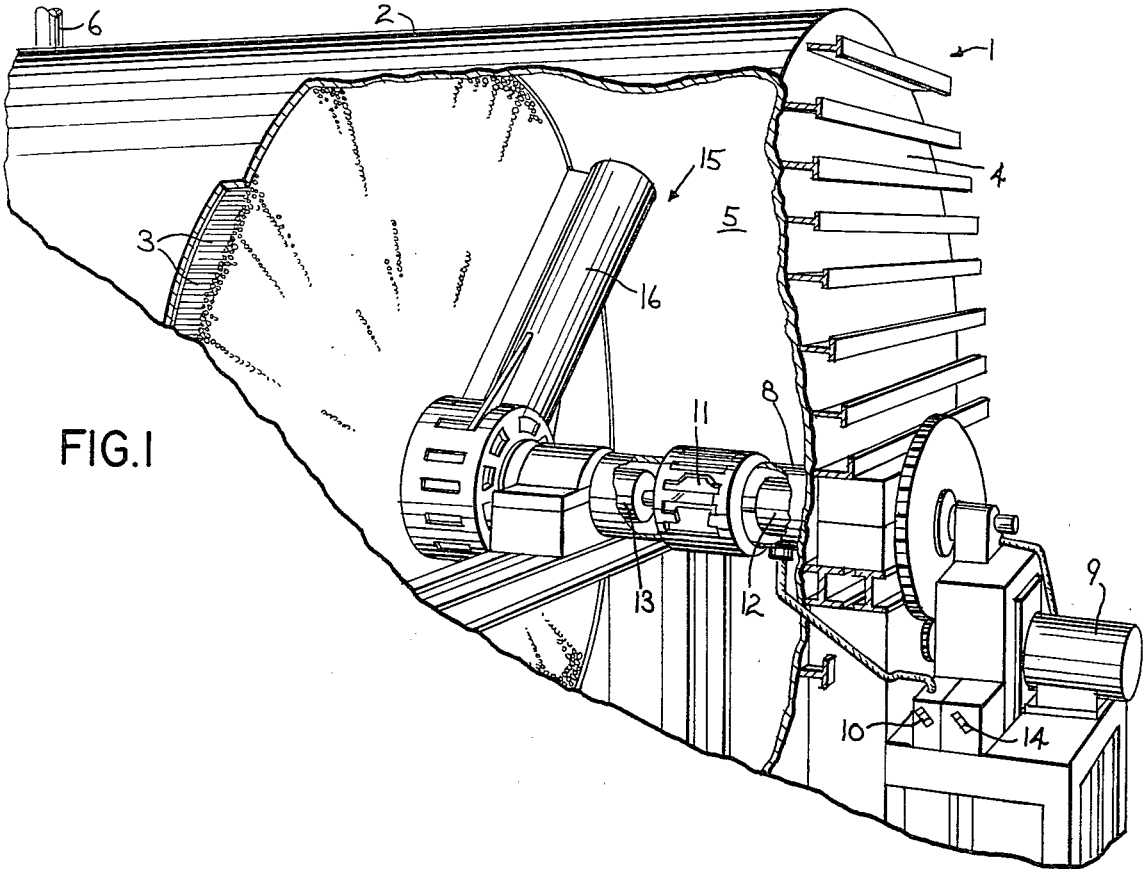
FIG. 1 is a fragmentary perspective view with parts broken away, of a heat exchanger condenser adapted to incorporate the various concepts of the invention.

Referring to FIG. 1, the condenser 1 has a housing 2 within which is disposed a very large plurality of tubes 3. These tubes extend from the upstream housing end (not shown) to a downstream terminus spaced rearwardly from the housing front wall 4 to form a chamber 5. Pressurized cooling water flowing downstream through the tubes discharges at the tube terminus and flows through chamber 5 and is discharged therefrom. The construction is such that chamber 5 is substantially filled with water during condenser operation. Steam from a turbine or the like passes into housing 2 through an inlet pipe 6, is condensed by contact with tubes 3, and is subsequently discharged therebelow.

Tubes 3 form a cylindrical mass and plate-like tube sheets 7 are disposed inwardly of the tube ends to hold them in position. See FIGS. 2 and 4.

It is desired to create a counter-flow of water within tubes 3 for cleaning purposes. As shown in FIG. 1, a large hollow rotor 8 is disposed within chamber 5 and is generally co-axial with housing 2 and the cylindrical mass of tubes 3. The outer end portion of rotor 8 extends through front wall 4 and is suitably connected to a drive motor 9 which, through a control switch 10, is actuated to rotate rotor 8. Rotor 8 is generally hollow and has an inlet 11 within chamber 5. A motor 12 drives a pump 13 within rotor 8, as via a control switch 14.

The rotor cavity leads inwardly from pump 13 to adjacent tubes 3 where it connects to a hood-like distributor arm assembly 15 mounted at one end to the inner end of rotor 8 and which extends radially outwardly along the tube ends. Arm assembly 15 comprises a generally cylindrical hollow housing 16, the side wall of which opens and faces toward tubes 3 by means of a pair of gradually converging spaced elongated lips 17 having resilient gasket sealing member 18 thereon, for purposes to be described.

Arm assembly 15 is adapted to co-act with cleaning means on tubes 3 which are formed into bundles by compartmentalizing means.

In the aforementioned application Ser. No. 920,644, and as represented in the prior art drawing of FIG. 2, the cleaning means comprises a plurality of basket assemblies 19 comprising longitudinal open cylindrical cages or baskets 20 having their inner ends secured to the outer ends of tubes 3, as by a press fit, and which extend outwardly beyond tube sheets 7. Thus, the basket chamber fluidically communicates with the interior of its respective tube. A cleaning element such as a brush 21 is disposed within the chamber formed by each basket 20. Water flowing outwardly from the tube ends forces brushes 21 into engagement with a stop 22 on the basket. Brushes 21 are of such a size that they can pass through tubes 3.

The tubes are formed into a plurality of bundles 23 arrayed in side-by-side relationship, with each bundle having a radial extent from the center of the cylinder and being generally edge-shaped. The bundles are separated and compartmentalized adjacent the tube ends by a plurality of radially extending gradually converging flow confinement plates or spacers 24 which are secured, as by welding, to the edges of tube sheets 7.

Figure 2:
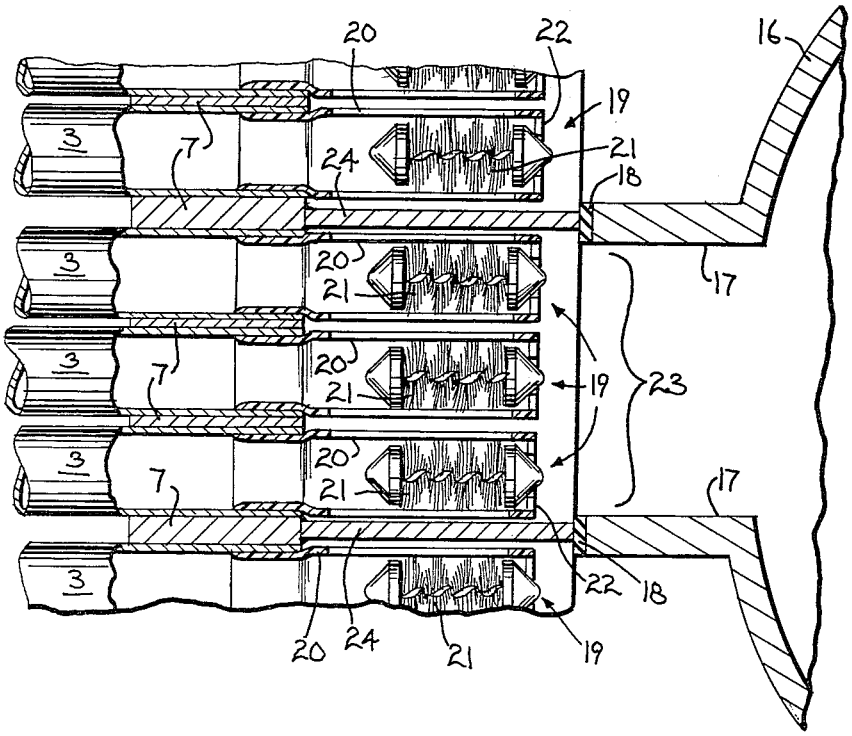
FIG.2 PRIOR ART
FIG. 2 is an enlarged partially sectional view of a prior art construction and showing the back-flow cover in registry with a prior form of tube compartment.

In the prior art showing of FIG. 2, rotation of arm assembly 15 causes lips 17 to progressively move across the plurality of bundles 23 in succession. As lips 17 register with the edges of spacers 24, between assemblies 19, a seal within the respective bundle is created. When pump motor 12 is actuated, water at a pressure higher than that flowing down through the tubes is caused to flow up through arm assembly 15, causing a counter-flow of water in the tubes. This causes brushes 21 to pass out of their cages and be propelled into the respective tubes to clean the latter. As lips 17 move out of registry with spacers 24, the counter-flow ceases and brushes 21 will return to their respective baskets 20.

As previously mentioned, installation of spacers 24 in previously built condensers may be extremely difficult. Furthermore, spacers 24 take up space which could well be used for more tubes in a new installation. These problems are solved by the present invention, which is illustrated primarily in FIGS. 3–5.

The invention contemplates that the compartmentalization of tubes 3 for fluid counter-flow is created by the basket assemblies themselves, thus eliminating the need for spacers 24.

Referring to FIGS. 3–5, each basket assembly 19*a* comprises the usual longitudinal open cage or basket 20*a* having its inner end formed for connection to the outer end of a tube 3, as by a press fit. Basket 20*a* contains the usual cleaning element, such as brush 21*a* and outer stops 22*a*.

In this instance, however, each basket assembly 19*a* which is to form the boundary of a desired tube bundle or compartment has formed therewith a longitudinal partition wall 25 which is connected to and closes one side portion of the basket 20*a*. Wall 25 is arcuate, with the inner end portion terminating outwardly from the basket inner end to form a stop 26 which engages the end of tube sheet 7 upon assembly into tubes 3, as shown in FIG. 4. The longitudinal edges of adjacent walls 25 of adjacent basket assemblies 19*a* are sealingly secured together by any suitable means, such as by a bead 27 of heat welded filler plastic compatable with the wall material.

Each partition wall 25 extends longitudinally outwardly from its respective basket 20 and terminates in a thickened lip 28, with lips 28 likewise being sealingly joined, as by plastic welding. Each lip 28 is arcuate, with its radius being greater than the radius of basket 20*a*.

The assembly of cleaning devices shown in FIG. 3 provides a continuous row of connected walls 25 which takes the place of a spacer 24.

FIG. 4 basically shows a single tube bundle 23*a*, bounded by a pair of an assembled multiplicity of partition walls 25, and wherein the lips 28 are spaced apart a distance generally equal to the spacing between arm lips 17. When arm assembly housing 16 moves into position so that lips 17 and/or their seals 18 register with the row of basket lips 28, the compartment is generally sealed and high counter-flow pressure will cause brushes 21*a* to move upstream to clean the tubes.

The compartment seal is enhanced by the fact that the arcuate extent of each lip 28 is no wider than the width of distributor arm portions 17, 18 which register with the contact surface formed by each radial row of basket lips 28, as shown in FIG. 5.

During arm-basket registry as shown in FIG. 4, the arm may exert inward pressure toward basket assemblies 19*a*. This pressure is resisted or absorbed by the supporting function of walls 25 which are confined against tube sheets 7.

The concepts of the invention provide a unique tube cleaning assembly which is easy to install, maintain and replace if necessary.

Various modes of carrying out the invention are contemplated as being within the scope of the following claims particularly pointing out and distinctly claiming the subject matter which is regarded as the invention.

I claim:

1. For use in a heat exchanger having a plurality of fluid flow tubes arranged with exposed open ends and wherein a fluid counter-flow arm is disposed adjacent and facing said open ends for movement thereacross, a tube cleaning element comprising:

(a) a generally cylindrical cage-like basket forming a chamber holding a cleaning member adapted to pass through a tube during counter-flow of fluid therethrough, (b) means on said basket for placing said basket in fluid communication with the interior of a said tube, (c) and means on said basket for cooperating with similar last-named means on adjacent baskets for forming a boundary in said plurality of tubes for use in compartmentalizing the latter, (d) the construction being such that said boundary-forming means is adapted to register with the said arm as the latter moves across the tubes.

2. The cleaning element of claim 1 in which said boundary forming means comprises a lip connected to and disposed longitudinally outwardly from said basket.

3. The cleaning element of claim 2 wherein the lips of adjacent boundary forming tube cleaning elements are joinable together to form an elongated contact surface registrable with said arm.

4. The cleaning element of claim 3 wherein said lips are arcuate.

5. The cleaning element of claim 4 wherein the arcuate extent of a said lip is no wider than the portion of said arm adapted to register with the lip.

6. The cleaning element of claim 4 or 5 wherein the radius of the arc of a said lip is greater than the radius of its respective basket.

7. The cleaning element of claim 2 or 5 which includes:

(a) a partition wall closing one side portion of said cage-like basket and extending longitudinally inwardly from its respective lip, (b) said wall forming means resisting longitudinal pressure exerted on said lip by the said arm upon registration therebetween.

8. The cleaning element of claim 7:

(a) wherein the heat exchanger includes tube sheets disposed adjacent said tubes, (b) and which include stop means on the inner end of said partition wall for engaging an adjacent tube sheet.

9. The cleaning element of claim 7 wherein the longitudinal edges of adjacent partition walls are joinable together to substantially prevent radial liquid passage therethrough.

* * * * *

UNITED STATES PATENT AND TRADEMARK OFFICE

CERTIFICATE OF CORRECTION

PATENT NO. : 4,353,414

DATED : October 12, 1982

INVENTOR(S) : GORDON F. LEITNER

It is certified that error appears in the above-identified patent and that said Letters Patent is hereby corrected as shown below:

Column 3, Line 41 Cancel "edge-shaped" and substitute therefor ----wedge-shaped----.

Signed and Sealed this

Seventh Day of December 1982

[SEAL]

*Attest:*

GERALD J. MOSSINGHOFF

*Attesting Officer* *Commissioner of Patents and Trademarks*